US009077065B2

(12) United States Patent
Yang et al.

(10) Patent No.: US 9,077,065 B2
(45) Date of Patent: Jul. 7, 2015

(54) MULTI-BAND ANTENNA

(71) Applicant: Cheng Uei Precision Industry Co., Ltd., New Taipei (TW)

(72) Inventors: Yi Ru Yang, New Taipei (TW); Pei Fen Wu, New Taipei (TW); Jia Hung Su, New Taipei (TW); Kai Shih, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 243 days.

(21) Appl. No.: 13/891,161

(22) Filed: May 9, 2013

(65) Prior Publication Data

US 2014/0333506 A1 Nov. 13, 2014

(51) Int. Cl.

| | |
|---|---|
| ***H01Q 1/38*** | (2006.01) |
| ***H01Q 5/00*** | (2015.01) |
| ***H01Q 5/307*** | (2015.01) |
| ***H01Q 5/357*** | (2015.01) |

(52) U.S. Cl.

CPC ..... *H01Q 5/0027* (2013.01); *H01Q 5/307* (2015.01); *H01Q 5/357* (2015.01)

(58) Field of Classification Search

USPC ..... 343/700 MS, 702

See application file for complete search history.

(56) References Cited

U.S. PATENT DOCUMENTS

| | | | | |
|---|---|---|---|---|
| 8,223,075 | B2 * | 7/2012 | Pan | 343/700 MS |
| 8,659,492 | B2 * | 2/2014 | Lee | 343/749 |
| 2012/0169555 | A1 * | 7/2012 | Tsou | 343/749 |
| 2014/0111381 | A1 * | 4/2014 | Lin | 343/700 MS |
| 2014/0313083 | A1 * | 10/2014 | Hsu et al. | 343/700 MS |
| 2015/0002339 | A1 * | 1/2015 | Lin et al. | 343/700 MS |

* cited by examiner

*Primary Examiner* — Tan Ho

(74) *Attorney, Agent, or Firm* — Cheng-Ju Chiang

(57) ABSTRACT

A multi-band antenna includes a base portion, a high-frequency radiating portion, a feeding portion and a low-frequency radiating portion. The base portion has a first transverse edge and a second transverse edge parallel to and opposite to the first transverse edge. The high-frequency radiating portion includes an inductance portion, a first extending portion, a second extending portion and a third extending portion. One side of a bottom of the feeding portion defines a feeding point. The low-frequency radiating portion has a bending portion, a coupling portion and an auxiliary portion. The base portion, the high-frequency radiating portion, the coupling portion and the auxiliary portion are coplanar. The base portion, the high-frequency radiating portion, the coupling portion and the auxiliary portion together with the bending portion are located in two perpendicular planes.

11 Claims, 3 Drawing Sheets

MULTI-BAND ANTENNA

BACKGROUND OF THE INVENTION

1. Field of the Invention

The present invention relates to an antenna, and more particularly to a built-in multi-band antenna.

2. The Related Art

As is known to all, a USB wireless network card is connected to a computer for receiving and sending wireless network signals. With the rapid development of the wireless communication industry, a conventional antenna is usually built in the USB wireless network card for improving a frequency covering range of wireless network signals of the USB wireless network card. Nevertheless, the conventional antenna built in the USB wireless network card has a complex structure. And the conventional antenna built in the USB wireless network card only receives and sends the wireless network signals corresponding to 2G (Second Generation) mobile communication standard and 3G (Third Generation) mobile communication standard that can't satisfy an increasing frequency band requirement.

So 4G (Fourth Generation) mobile communication standard gradually replaces the 2G mobile communication standard and the 3G mobile communication standard. A LTE (Long Term Evolution) technology is a wireless network technology corresponding to the 4G mobile communication standard. The LTE communication standard is compatible with the GSM (Global System of Mobile Communication) standard, and is gradually being accepted by countries around the world to become the 4G mobile communication standard.

However, in order to satisfy the increasing frequency band requirement and cooperate with the LTE frequency bands used by the countries around the world, and also considering a limitation of an internal space of the USB wireless network card, it's necessary to provide a multi-band antenna which is built in the USB wireless network card, and receives and sends the multi-band wireless network signals covering the LTE frequency bands.

SUMMARY OF THE INVENTION

An object of the present invention is to provide a multi-band antenna. The multi-band antenna includes a base portion, a high-frequency radiating portion, a feeding portion and a low-frequency radiating portion. The base portion has a first transverse edge and a second transverse edge parallel to and opposite to the first transverse edge. The first transverse edge is in front of the second transverse edge. The high-frequency radiating portion includes an inductance portion extending forward from a left side of the first transverse edge of the base portion, a first extending portion extending forward from a right side of the first transverse edge of the base portion, a second extending portion extending leftward from a front end of the first extending portion and a third extending portion extending forward from a left side of a front edge of the second extending portion. The feeding portion extends downward and then extends forward from the second transverse edge of the base portion. One side of a bottom of the feeding portion defines a feeding point. The low-frequency radiating portion has a bending portion extending forward, then extending downward and further continuously meandering leftward, a coupling portion extending rearward and then extending towards the second extending portion from a distal end of the bending portion, and an auxiliary portion extending rearward and then extending towards the inductance portion from a distal end of the coupling portion. The base portion, the high-frequency radiating portion, the coupling portion and the auxiliary portion are coplanar. The base portion, the high-frequency radiating portion, the coupling portion and the auxiliary portion together with the bending portion are located in two perpendicular planes.

As described above, the built-in multi-band antenna has a simple and regular structure by virtue of the base portion, the high-frequency radiating portion, the coupling portion and the auxiliary portion being coplanar, and the base portion, the high-frequency radiating portion, the coupling portion and the auxiliary portion together with the bending portion being located in the two perpendicular planes, so the multi-band antenna is built in a USB wireless network card within a limitation of an internal space of the USB wireless network card. Furthermore, the multi-band antenna receives and sends multi-band wireless network signals covering LTE frequency bands.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
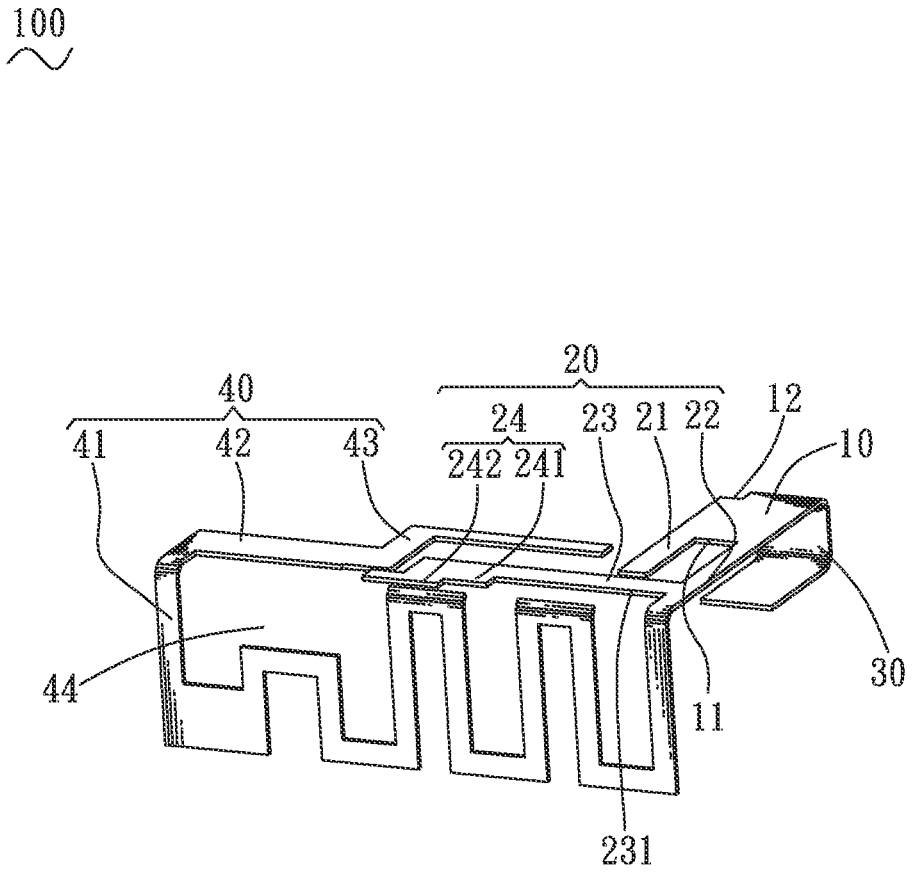
FIG. 1 is a perspective view of a multi-band antenna in accordance with an embodiment of the present invention.
Figure 2:
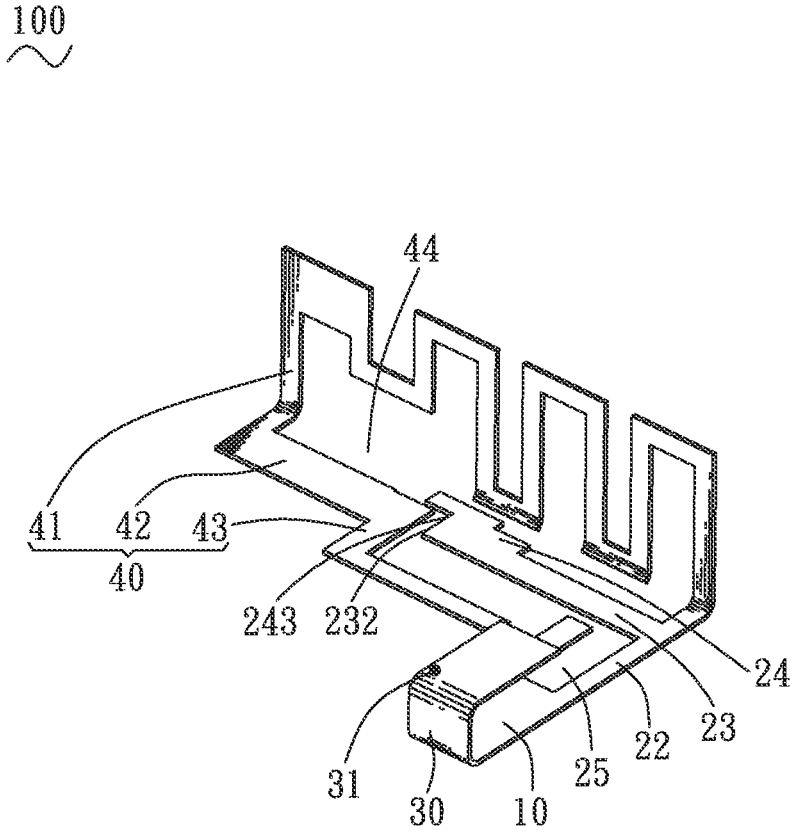
FIG. 2 is another perspective view of the multi-band antenna of FIG. 1.
Figure 3:
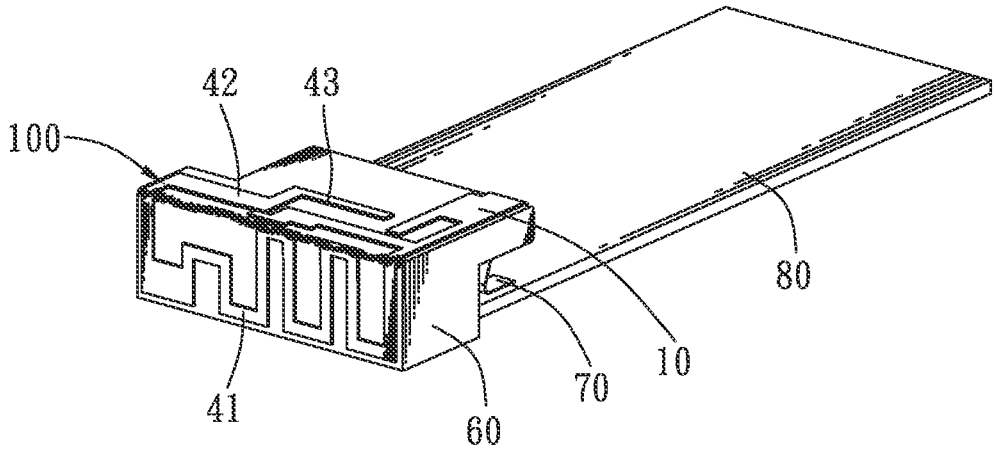
FIG. 3 is a perspective view of the multi-band antenna of FIG. 1, wherein the multi-band antenna is electrically connected with a printed circuit board of a USB wireless network card.

Referring to FIG. 1, FIG. 2 and FIG. 3, a multi-band antenna 100 in accordance with an embodiment of the present invention is shown. The multi-band antenna 100 is built in a USB wireless network card for receiving and sending multi-band wireless network signals covering LTE frequency bands. The multi-band antenna 100 includes a base portion 10, a high-frequency radiating portion 20, a feeding portion 30 and a low-frequency radiating portion 40. The multi-band antenna 100 is formed by a technology of etching a flexible printed circuit board.

Referring to FIG. 1 and FIG. 2, the base portion 10 of a rectangular board shape has a first transverse edge 11 and a second transverse edge 12 parallel to and opposite to the first transverse edge 11. The first transverse edge 11 is in front of the second transverse edge 12. The high-frequency radiating portion 20 includes an inductance portion 21 extending forward from a left side of the first transverse edge 11 of the base portion 10, a first extending portion 22 extending forward from a right side of the first transverse edge 11 of the base portion 10, a second extending portion 23 extending leftward from a front end of the first extending portion 22 and a third extending portion 24 extending forward from a left side of a front edge 231 of the second extending portion 23. The first extending portion 22 is spaced from and parallel to the inductance portion 21. A first interspace 25 is remained between the inductance portion 21 and the first extending portion 22 to form a simulating inductance effect for tuning high-frequency bandwidth and input impedance of the multi-band antenna 100, so that receiving and sending performance at high-frequency wireless network signals of the multi-band antenna 100 are improved. The second extending portion 23 is spaced from and located in front of the inductance portion 21.

Referring to FIG. 1 and FIG. 2, the third extending portion 24 includes a first strip 241 extending forward from a left side of the front edge 231 of the second extending portion 23 and a second strip 242 extending forward and then extending leftward from a left side of a front of the first strip 241. The second extending portion 23, the first strip 241 and the second strip 242 are arranged as a stair shape. The second extending portion 23 has a left side edge 232 perpendicular to the front edge 231, and the first strip 241 of the third extending portion 24 has a left lateral edge 243 flush with the left side edge 232 of the second extending portion 23. A left side of the second strip 242 of the third extending portion 24 extends beyond the left lateral edge 243 of the first strip 241 of the third extending portion 24.

Referring to FIG. 1 and FIG. 2, the feeding portion 30 extends downward and then extends forward from the second transverse edge 12 of the base portion 10. One side of a bottom of the feeding portion 30 defines a feeding point 31.

Referring to FIG. 1, FIG. 2 and FIG. 3, the low-frequency radiating portion 40 has a bending portion 41 extending forward, then extending downward and further continuously meandering leftward, a coupling portion 42 extending rearward and then extending towards the second extending portion 23 from a distal end of the bending portion 41, and an auxiliary portion 43 extending rearward and then extending towards the inductance portion 21 from a distal end of the coupling portion 42. The bending portion 41 is located in front of the base portion 10, the high-frequency radiating portion 20, the feeding portion 30, the coupling portion 42 and the auxiliary portion 43. The base portion 10, the high-frequency radiating portion 20, the coupling portion 42 and the auxiliary portion 43 are coplanar. The base portion 10, the high-frequency radiating portion 20, the coupling portion 42 and the auxiliary portion 43 together with the bending portion 41 are located in two perpendicular planes. So the multi-band antenna 100 has a simple and regular structure to be built in the USB wireless network card within a limitation of an internal space of the USB wireless network card.

Referring to FIG. 1 and FIG. 2, the coupling portion 42 is spaced from and located behind the second strip 242 of the third extending portion 24, and the distal end of the coupling portion 42 approaches to and is spaced from the second extending portion 23 and the first strip 241 of the third extending portion 24. The coupling portion 42 is spaced from a left side of the bending portion 41. A second interspace 44 is remained between the coupling portion 42 and the left side of the bending portion 41 to form a simulating capacitance effect for tuning low-frequency bandwidth and input impedance of the multi-band antenna 100, so that receiving and sending performance of the multi-band antenna 100 at low-frequency wireless network signals are improved. The auxiliary portion 43 is spaced from and located behind the second extending portion 23 and the third extending portion 24, and a distal end of the auxiliary portion 43 approaches to and is spaced from the inductance portion 21.

Referring to FIG. 1, FIG. 2 and FIG. 3, in use, when the multi-band antenna 100 is built in the USB wireless network card, the multi-band antenna 100 is fastened to an insulating element 60 and is supported by the insulating element 60. The USB wireless network card includes a connecting element 70 and a circuit board 80. The connecting element 70 is fastened to the bottom of the feeding portion 30 and a bottom of the connecting element 70 is electrically connected to the circuit board 80 so as to make the multi-band antenna 100 electrically connected to the circuit board 80.

Referring to FIG. 1, FIG. 2 and FIG. 3, when the multi-band antenna 100 is used in wireless communication, the multi-band antenna 100 is built in the USB wireless network card for receiving and sending the multi-band wireless network signals covering LTE frequency bands and an electric current is fed into the built-in multi-band antenna 100 via the feeding point 31. The high-frequency radiating portion 20 receives and sends the high-frequency wireless network signals covering a first frequency band ranged between 1710 MHz and 1990 MHz and a second frequency band ranged between 1990 MHz and 2170 MHz, and the low-frequency radiating portion 40 receives and sends the low-frequency wireless network signals covering a third frequency band ranged between 700 MHz and 960 MHz.

As described above, the built-in multi-band antenna 100 has a simple and regular structure by virtue of the base portion 10, the high-frequency radiating portion 20, the coupling portion 42 and the auxiliary portion 43 being coplanar, and the base portion 10, the high-frequency radiating portion 20, the coupling portion 42 and the auxiliary portion 43 together with the bending portion 41 being located in the two perpendicular planes, so the multi-band antenna 100 is built in the USB wireless network card within the limitation of the internal space of the USB wireless network card. Furthermore, the multi-band antenna 100 receives and sends the multi-band wireless network signals covering the LTE frequency bands.

What is claimed is:

1. A multi-band antenna, comprising:

a base portion having a first transverse edge and a second transverse edge parallel to and opposite to the first transverse edge, the first transverse edge being in front of the second transverse edge;

a high-frequency radiating portion including an inductance portion extending forward from a left side of the first transverse edge of the base portion, a first extending portion extending forward from a right side of the first transverse edge of the base portion, a second extending portion extending leftward from a front end of the first extending portion and a third extending portion extending forward from a left side of a front edge of the second extending portion;

a feeding portion extending downward and then extending forward from the second transverse edge of the base portion, one side of a bottom of the feeding portion defining a feeding point; and a low-frequency radiating portion having a bending portion extending forward, then extending downward and further continuously meandering leftward, a coupling portion extending rearward and then extending towards the second extending portion from a distal end of the bending portion, and an auxiliary portion extending rearward and then extending towards the inductance portion from a distal end of the coupling portion, the base portion, the high-frequency radiating portion, the coupling portion and the auxiliary portion being coplanar, the base portion, the high-frequency radiating portion, the coupling portion and the auxiliary portion together with the bending portion being located in two perpendicular planes.

2. The multi-band antenna as claimed in claim 1, wherein the third extending portion includes a first strip extending forward from a left side of the front edge of the second extending portion and a second strip extending forward and then extending leftward from a left side of a front of the first strip, the second extending portion, the first strip and the second strip are arranged as a stair shape.

3. The multi-band antenna as claimed in claim 2, wherein the second extending portion has a left side edge perpendicular to the front edge of the second extending portion, and the first strip of the third extending portion has a left lateral edge flush with the left side edge of the second extending portion, a left side of the second strip of the third extending portion extends beyond the left lateral edge of the first strip of the third extending portion.

4. The multi-band antenna as claimed in claim 2, wherein the coupling portion is spaced from and located behind the second strip of the third extending portion, and the distal end of the coupling portion approaches to and is spaced from the second extending portion and the first strip of the third extending portion.

5. The multi-band antenna as claimed in claim 1, wherein the auxiliary portion is spaced from and located behind the second extending portion and the third extending portion, and a distal end of the auxiliary portion approaches to and is spaced from the inductance portion.

6. The multi-band antenna as claimed in claim 1, wherein the second extending portion is spaced from and located in front of the inductance portion.

7. The multi-band antenna as claimed in claim 1, wherein the first extending portion is spaced from and parallel to the inductance portion, a first interspace is remained between the inductance portion and the first extending portion to form a simulating inductance effect.

8. The multi-band antenna as claimed in claim 1, wherein the bending portion is located in front of the base portion, the high-frequency radiating portion, the feeding portion, the coupling portion and the auxiliary portion.

9. The multi-band antenna as claimed in claim 1, wherein the coupling portion is spaced from a left side of the bending portion, a second interspace is remained between the coupling portion and the left side of the bending portion to form a simulating capacitance effect.

10. The multi-band antenna as claimed in claim 1, wherein the high-frequency radiating portion receives and sends high-frequency wireless network signals covering a first frequency band ranged between 1710 MHz and 1990 MHz and a second frequency band ranged between 1990 MHz and 2170 MHz, and the low-frequency radiating portion receives and sends low-frequency wireless network signals covering a third frequency band ranged between 700 MHz and 960 MHz.

11. The multi-band antenna as claimed in claim 1, wherein the multi-band antenna is built in a USB wireless network card, the multi-band antenna is fastened to an insulating element and is supported by the insulating element, the USB wireless network card includes a connecting element and a circuit board, the connecting element is fastened to the bottom of the feeding portion and a bottom of the connecting element is electrically connected to the circuit board so as to make the multi-band antenna electrically connected to the circuit board.

* * * * *